US006871980B2

(12) United States Patent
Chen

(10) Patent No.: US 6,871,980 B2
(45) Date of Patent: Mar. 29, 2005

(54) DECORATIVE APPARATUS WITH MULTI-LAYER LIGHTING PLATES

(76) Inventor: Ching-Huai Chen, 2F-1, No. 152, Nan Yar Street, Hsinchu City (TW)

( * ) Notice: Subject to any disclaimer, the term of this patent is extended or adjusted under 35 U.S.C. 154(b) by 4 days.

(21) Appl. No.: 10/384,582

(22) Filed: Mar. 11, 2003

(65) Prior Publication Data

US 2004/0179375 A1 Sep. 16, 2004

(51) Int. Cl.[7] ..... F21S 13/14

(52) U.S. Cl. ..... 362/252; 362/238; 362/247; 362/248; 362/360; 362/806

(58) Field of Search ..... 362/234, 238, 362/249, 252, 396, 565, 243, 247, 248, 360, 806, 808

(56) References Cited

U.S. PATENT DOCUMENTS 4,164,008 A * 8/1979 Miller et al. ..... 362/103
4,381,537 A * 4/1983 Hinrichs ..... 362/500
5,097,398 A * 3/1992 Dye ..... 362/147
5,161,882 A * 11/1992 Garrett ..... 362/249
6,318,882 B1 * 11/2001 Chang ..... 362/252
6,322,237 B1 * 11/2001 Lee ..... 362/500
6,692,139 B2 * 2/2004 Kotovsky ..... 362/368

* cited by examiner

*Primary Examiner*—John Anthony Ward
(74) *Attorney, Agent, or Firm*—Rosenberg, Klein & Lee

(57) ABSTRACT

The present invention relates to a decorative apparatus with multi-layer of lighting plates, which includes a first plate having a designed shape and being not transparent and a second plate having a reflecting surface. Several bulbs are provided between the two plates. By use of the light of the bulb, the decorative effect is novel and unique while the reflecting light showing the special figure of the first plate.

7 Claims, 3 Drawing Sheets

DECORATIVE APPARATUS WITH MULTI-LAYER LIGHTING PLATES

BACKGROUND OF THE INVENTION

It is popular that a conventional decorative plate is mounted with many bulbs to display a special figure. The figure is formed by arrangement of the bulbs on the single plate or frame and the decorative effect is obtained as the bulbs are lightened. The outcome of the conventional single lighting plate is monotonous.

Accordingly, the present invention mainly provides an improved decorative apparatus, which includes several layers of plates mounted with bulbs to display a various decorative effect by use of the reflection of the lights.

BRIEF DESCRIPTION OF THE DRAWINGS

Now the features and advantages of the present invention will be describes in detail with reference to the accompanying drawings.

DETAILED DESCRIPTION OF THE INVENTION

Figure 1:
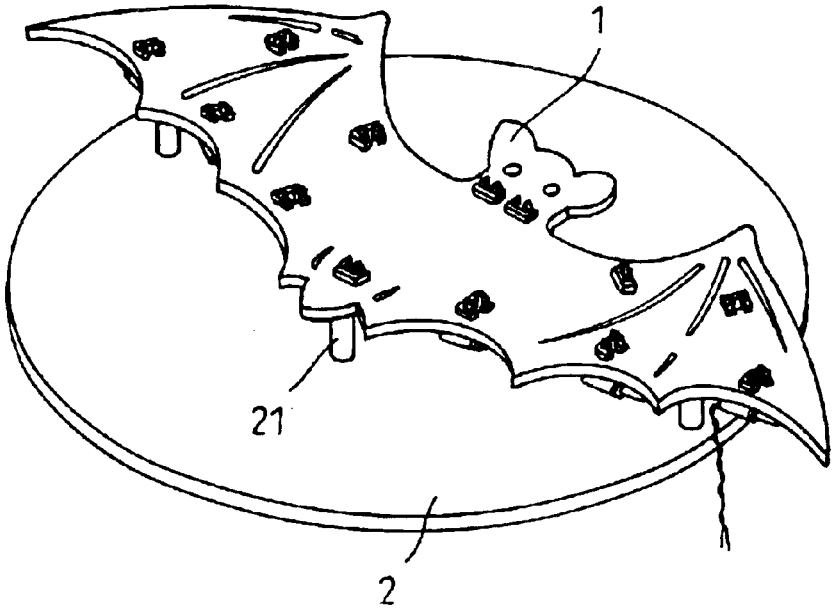
FIG. 1 shows a perspective view of a decorative apparatus with two layers of lighting plates according to the present invention.
Figure 2:
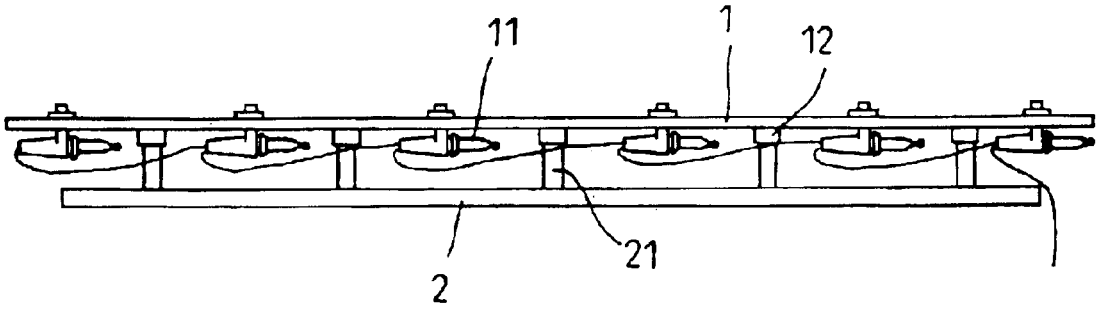
FIG. 2 shows a plan view of FIG. 1.
Figure 3:
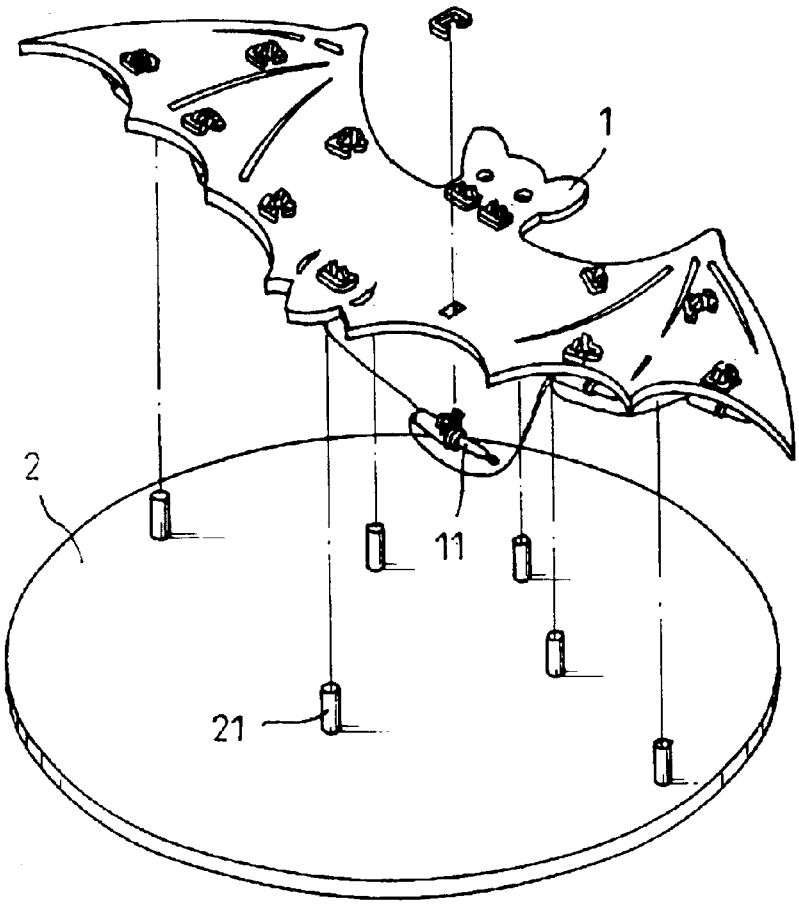
FIG. 3 shows an exploded view of FIG. 1.
Figure 4:
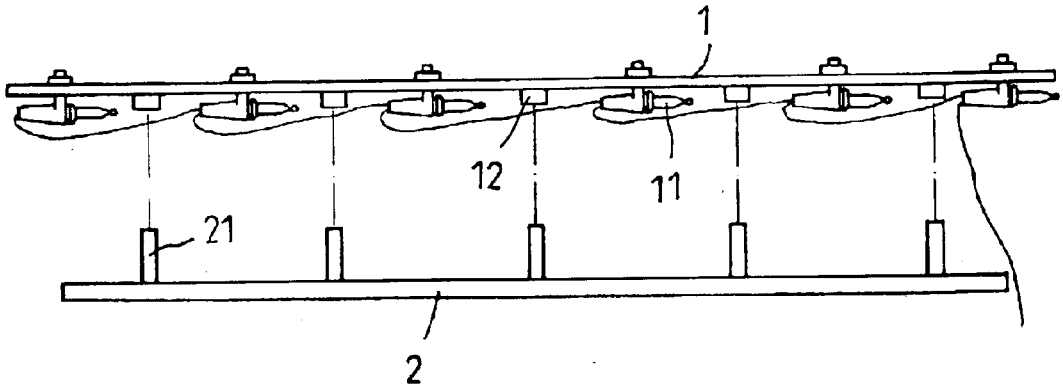
FIG. 4 shows an exploded view of FIG. 2.

The present invention relates to a decorative apparatus with multi-layer of lighting plates. In the following embodiment, a decorative apparatus with two layers of lighting plates will be described for example. Please referring to FIG. 1 to 4, the apparatus of the present invention includes a first plate (1) and a second plate (2). The first plate (1) is not transparent and can be designed to have a special decorative shape. The first plate (1) has connected with several bulbs (1) and several receivers (12) at the bottom side. The second plate (2) has a reflecting surface and connects with several rods (21), each of which is related to the receiver (12) under the first plate (1) for engagement of the two plates.

In use, the bulb (11) emits the light on the second plate (2) while the light will be reflected and the reflected light will display the shape of the first plate (1) because the first plate

(1) is not transparent. The outcome is the decorative figure of the first plate (1) floating on the shining second plate (2) that obtains a novel and unique decorative effect.

Figure 5:
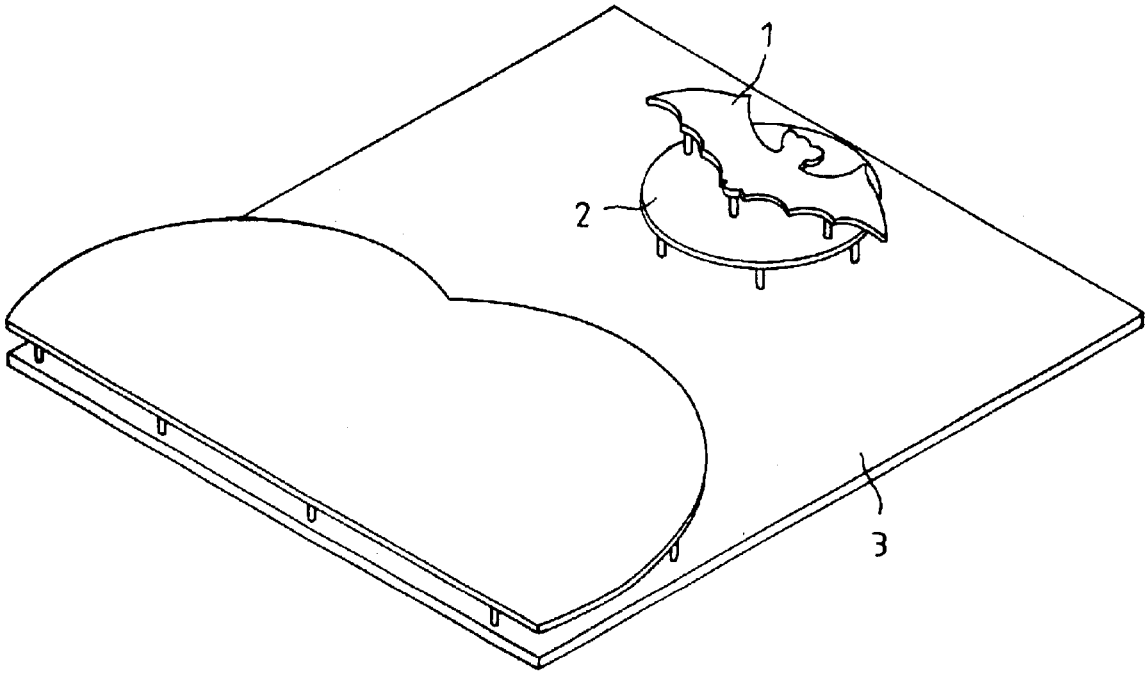
FIG. 5 shows a perspective view of a modified decorative apparatus with three layers of lighting plates according the present invention.
Figure 6:
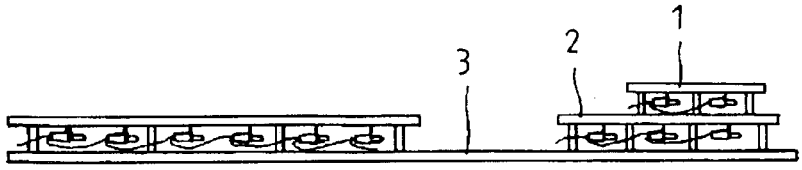
FIG. 6 shows a plan view of FIG. 5.

Based on the same technique, FIGS. 5 and 6 show another embodiment of the present invention, which includes a third lighting plate (3) under the second plate (2) while several bulbs (11) are provided between the second plate (2) and the third plate (3). It will be understood that a fourth plate or more plates can be connected to form the apparatus of the present invention.

What is claimed is:

1. A decorative lighting apparatus comprising:

a plurality of lighting plate layers, adjacent ones of said lighting plate layers being spaced one from the other by a plurality of rods extending therebetween;

at least a first of said lighting plate layers being formed of a non-transparent material for blocking the passage of light therethrough, said first lighting plate layer defining a bottom surface;

at least a second of said lighting plate layers having a reflective surface opposing said bottom surface of said first lighting plate layer;

a plurality of bulbs disposed between said bottom and reflective surfaces, light emitted by said bulbs and reflected by said reflecting surface passing peripherally about said first lighting plate layer to generate a silhouetted lighting effect thereabout.

2. The decorative lighting apparatus as recited in claim 1, wherein said rods are formed on one of said first and second plate layers to project therefrom, the other of said first and second plate layers including a plurality of receivers respectively engaging said rods.

3. The decorative lighting apparatus as recited in claim 1, wherein said first lighting plate layer defines peripherally a predetermined special shape.

4. The decorative lighting apparatus as recited in claim 1, wherein said reflective surface of said second lighting plate layer extends peripherally beyond said first lighting plate layer.

5. The decorative lighting apparatus as recited in claim 1, wherein said bulbs are secured to said first lighting plate layer to be disposed adjacent said bottom surface thereof.

6. The decorative lighting apparatus as recited in claim 1 further comprising at least a third lighting plate layer disposed beneath said second lighting plate layer, spaced by a plurality of said rods therefrom.

7. The decorative lighting apparatus as recited in claim 6, wherein a plurality of bulbs are disposed between said second and third lighting plate layers.

* * * * *